US005413084A

United States Patent [19]

Haggard

[11] Patent Number: 5,413,084

[45] Date of Patent: May 9, 1995

[54] COMBINED ARCHERY SIGHT AND ARROW REST

[76] Inventor: Alan Haggard, 3950 Clyde Rd., Holly, Mich. 48442

[21] Appl. No.: 159,844

[22] Filed: Dec. 1, 1993

[51] Int. Cl.[6] ..... F41B 5/22; F41G 1/467

[52] U.S. Cl. ..... 124/44.5; 124/87; 33/265

[58] Field of Search ..... 124/23.1, 24.1, 25.6, 124/86, 87, 88, 44.5; 33/265

[56] References Cited

U.S. PATENT DOCUMENTS

| | | | |
|---|---|---|---|
| 3,245,393 | 4/1966 | Rose | 33/265 X |
| 3,561,418 | 2/1971 | Fredrickson | 124/87 X |
| 3,618,586 | 11/1971 | Current et al. | 124/87 |
| 4,332,231 | 6/1982 | Napier et al. | 124/24.1 |
| 4,351,311 | 9/1982 | Phares | 124/44.5 |
| 4,377,152 | 3/1983 | Saunders | 124/88 |
| 4,587,945 | 5/1986 | Little | 124/87 |
| 4,788,961 | 12/1988 | Toth | 124/24.1 |
| 4,879,988 | 11/1989 | Larson | 124/44.5 |
| 4,917,072 | 4/1990 | Chang | 124/44.5 |
| 5,022,378 | 6/1991 | Rhodehouse et al. | 124/44.5 |
| 5,090,805 | 2/1992 | Stawarz | 356/251 |
| 5,092,052 | 3/1992 | Godsey | 33/265 |
| 5,092,308 | 3/1992 | Sheffield | 124/25 |
| 5,174,269 | 12/1992 | Sappington | 124/87 |
| 5,205,268 | 4/1993 | Savage | 124/24.1 |
| 5,253,633 | 10/1993 | Sisko | 124/44.5 |

*Primary Examiner*—Randolph A. Reese
*Assistant Examiner*—John A. Ricci
*Attorney, Agent, or Firm*—Howard & Howard

[57] ABSTRACT

An improved archery sight and arrow rest combination incorporates the positioning of the sight generally vertically above the arrow rest. Positioning of the sight generally vertically above the arrow rest eliminates any undesirable effects from archer induced torque on the bow handle. Both the sight and rest are positioned rearwardly of the bow handle. Should the bow handle be twisted due to archer induced torque, both the sight and arrow rest will move to effectively the same position. Thus, when the archer sights along the sight member, the arrow will be pointing in the same direction. In the prior art, the arrow rest was often behind the bow handle with the sight in front of the bow handle. When archer induced torque occurred, the archer would be sighting along one line, while the arrow would actually be aimed along another. The present invention has addressed this problem. In addition, the present invention provides a one-piece easily removable sight and arrow rest combination that the archer may quickly and easily remove. Since the sight and arrow rest are delicate members, facilitating the removal by the archer will ensure that they are easily protected during transport.

20 Claims, 3 Drawing Sheets

Fig-3
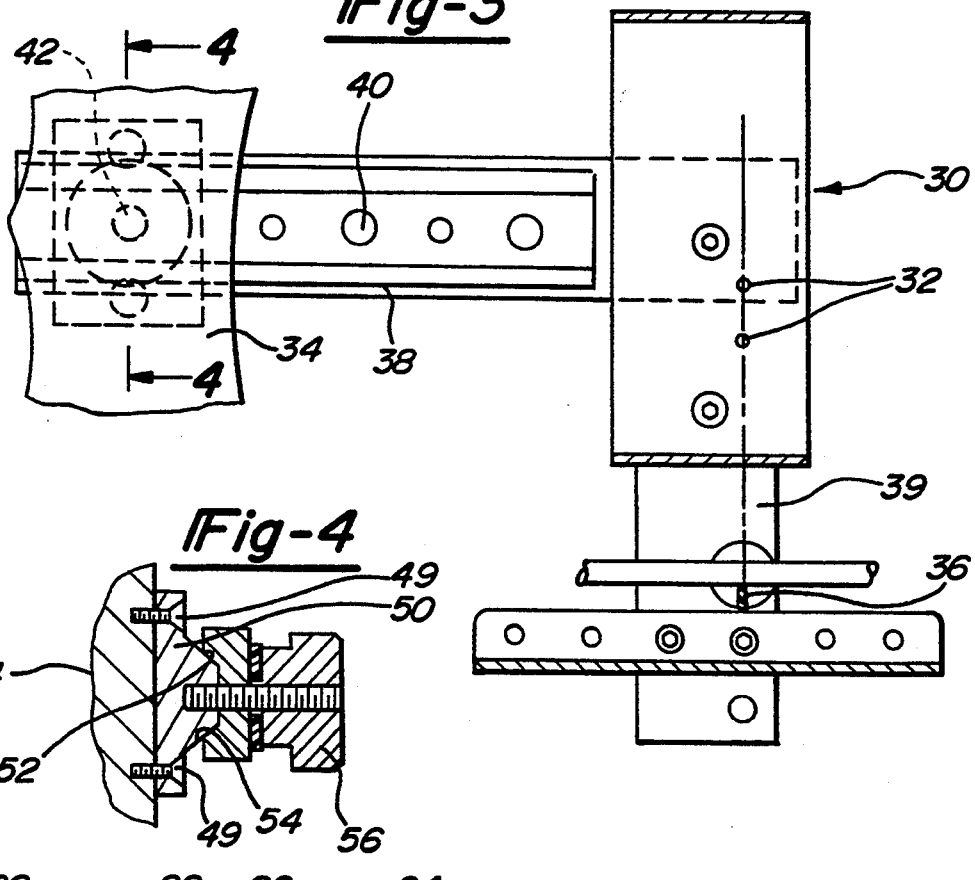
Fig-4
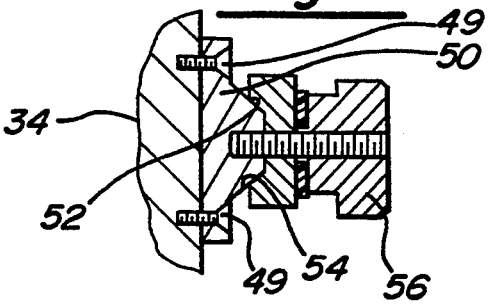
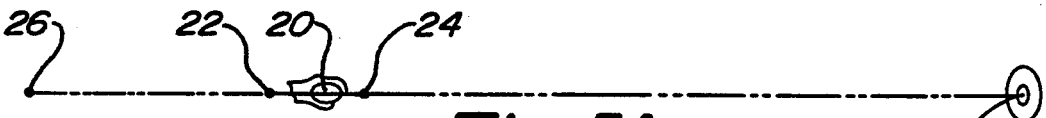
Fig-5A
PRIOR ART
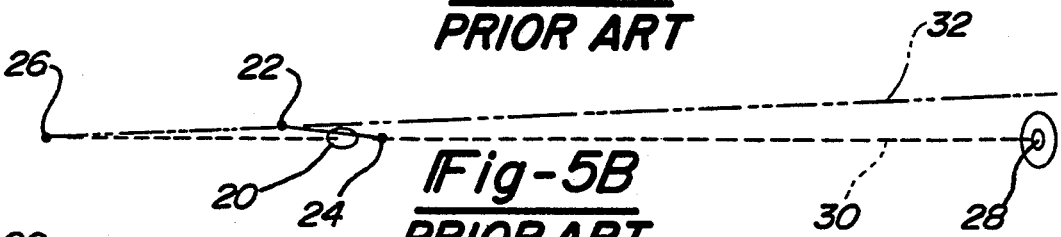
Fig-5B
PRIOR ART
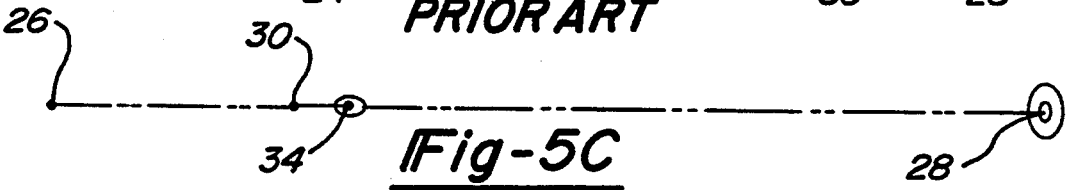
Fig-5C
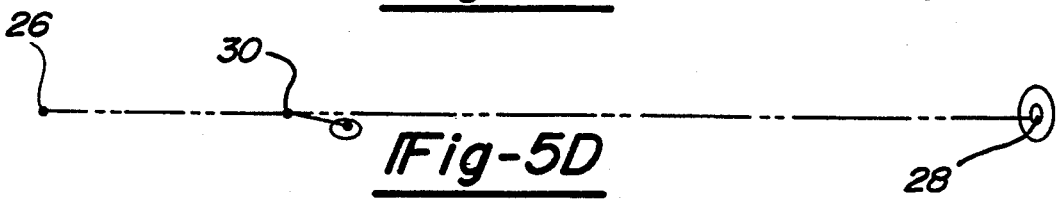
Fig-5D

COMBINED ARCHERY SIGHT AND ARROW REST

BACKGROUND OF THE INVENTION

This application in general relates to an improved archery sight and overdraw arrow rest which are both positioned rearwardly of the bow handle toward the archer. The inventive combination eliminates any undesirable effect on aiming accuracy from archer-induced torque on the bow handle. Moreover, the combination is removable from the bow handle as a one-piece item.

Archery requires precise aiming. To that end, even small improvements in the ability to sight, or in improving the dynamic flight characteristics or ballistics of the arrow are valuable benefits. To this end, the archery industry has embraced the concept of a "overdraw" arrow rest, which is attached to the bow handle and brings the arrow rest several inches rearwardly of the bow handle. This allows an archer to utilize a somewhat shorter arrow than would otherwise be required. The shorter arrow is lighter and thus provides higher velocity, and a flatter trajectory in flight. Moreover, the shorter arrow has a stiffer shaft which allows a thinner wall, further reducing weight. Thus, the archery industry has accepted the overdraw arrow rest as a valuable improvement.

The sighting devices utilized in archery have not changed greatly over the years. In most modern sighting systems, a sight extends forwardly of the bow handle. A rear sight is provided by a peep sight attached to the bow string. The archer aligns the peep sight, the forward sight that is positioned forwardly of the handle, and a target. In this application, the term target will be utilized to refer to game, or an actual target.

Problems arise with modern sight assemblies due to archer induced torque. Archer induced torque is a tendency of an archer to twist the handle either to the left or right. This problem is particularly acute when an archer becomes nervous such as when game is sighted or when shooting in target competition. Applicant has identified a problem wherein the undesirable effects of torque are made even more acute when a sight is positioned forwardly of the handle in conjunction with an arrow rest positioned rearward of the handle.

As shown in FIG. 5A, handle 20 has an overdraw rest 22 rearwardly of the handle, a sight 24 forwardly of the handle and a peep sight 26 on the bow string. In the situation shown in FIG. 5A there is no torque imposed. Thus, points 26, 22 and 24 are aligned along a straight line and the archer may aim the line between the peep sight 26 and sight 24 at the target 28, and the rest 22 (and consequently the arrow) should be aimed at the target 28.

In reality, however, archer induced torque often throws the aiming of the arrow off, as is illustrated in FIG. 5B. As shown in FIG. 5B, the archer has induced some rightward torque by twisting handle 20 such that the sight 24 is now twisted to the right of the center line of the handle. As shown, this would result in the arrow rest 22 moving to the left of the center line of the handle. A line 30 shows the sighting line the archer would now perceive that he is aiming along from peep sight 26 and through sight 24. As is shown by line 32, however, the actual flight of the arrow would be from the peep sight 26, and through the arrow rest 22. That line 32 is shown to be spaced to the left from line 30.

The art has not recognized that increasing the distance between the sight and the arrow rest makes the torque problem more pronounced. It would appear that the archery industry believes that by putting the sight forwardly of the handle, and consequently closer to the target, one improves sighting accuracy. As discussed above, applicant has discovered that in fact the positioning of the sight forwardly of the handle does not improve sighting, but rather makes the problem of torque even more pronounced. Thus, archer induced torque has provided a very real problem in the field that is made even more severe when an overdraw arrow is utilized with a sight positioned forwardly of the bow.

Attempts have been made to correct the torque problem. One example is disclosed in U.S. Pat. No. 5,205,268. In this patent, the sight is still spaced from the arrow rest. This patent treats the torque problem by essentially having the archer make a check for the existence of torque prior to aiming and shooting. The archer can supposedly identify the torque and then correct the problem by twisting the handle back to its proper line. This method may help eliminate torque in some instances; however, the archer can never be assured there will be no torque on the handle at the moment of release, as his concentration would be on the target. Further, this method adds an additional step, further complicating the shooting process.

SUMMARY OF THE INVENTION

Applicant's invention provides a solution to undesirable effects created by archer induced torque on the handle. Applicant's invention does not attempt to eliminate torque, but rather neutralizes any undesirable effects that may flow from such torque. In one disclosed embodiment of this invention, applicant positions both the arrow rest and the sight rearwardly of the bow handle at generally the same distance from the bow handle. In a sense, it could be said that a single vertical axis could pass through both the sight and the rearwardmost point of the arrow rest. Thus, should there be any archer induced torque the aiming line throughout the sight and the arrow travel line throughout the rest will be the same. The archer will continue to sight from the peep sight on the bow string to the sight and at the target. Since the sight line and the arrow rest line are now identical, any ill effect from the torque will be neutralized. The archer, even though torquing the handle to the right or left, will still be actually aiming the arrow at the target.

In one disclosed embodiment of this invention, a sight is connected to the standard sight hole on a bow handle and has a rearwardly extending bar extending rearwardly from the bow handle. A downwardly extending bar is connected to the rearwardly extending bar. The sight is connected to a top of the downwardly extending bar, and the arrow rest is connected to the downwardly extending bar at a vertically lower position. Since the sight and rest are both connected to the same bar, one can be assured that they will remain in the inventive desired position where they are generally aligned along a single vertical axis. Although it is most preferred that the arrow rest and sight be identically positioned on the same vertical line, this invention has utilized the term "generally" to refer to their alignment in some instances. While it would be most preferred that they be exactly aligned, some spacing may be acceptable. Preferably, a vertical axis drawn through the sight is within one inch of a vertical axis drawn through the rearward most point of the arrow rest. In no event should the spacing be greater than two inches.

In other preferred features of the invention, the one-piece sight/rest assembly has a plurality of holes through the rearwardly extending bar such that the distance from the bow handle to the arrow rest and sight may be adjusted. Further, the attachment of the one-piece sight/rest assembly to the bow handle preferably occurs by positioning the rearwardly extending bar on an attachment member on the bow handle adjacent to the standard attachment hole for the sight. A threaded nut or knob is used to connect the rearwardly extending bar to a bolt on the handle facilitating its easy removal.

In another feature of this invention, the downwardly extending bar includes a plurality of holes such that the distance between the sight and the rest may be also be adjusted. In one further most preferred embodiment of this invention, the connection of the rearwardly extending bar to the downwardly extending bar is made by at least two bolts with a first bolt spaced more rearwardly than the second bolt. In this way, any twisting between the downwardly and rearwardly extending bars is eliminated, and the archer may be fairly certain that the downwardly extending bar is extending generally vertically. In a further feature of the invention, the connection between the bow handle and the rearwardly extending bar include a mounting member having a cross-section, here a truncated triangle, which ensures that the rearwardly extending bar is extending generally perpendicular to the bow handle. Again, this will ensure that the downwardly extending bar extends generally vertically, and that the sight/arrow rest combination is positioned accurately relative to the bow handle. Further, the exact placement of the rest and sight will be easily and quickly duplicated when removing and replacing the combination.

In one main benefit of this invention, since the sight and rest are both removable as a one-piece unit, the archer will easily be able to remove the unit when the bow is stored. Since the relative position of the sight and rest are an important feature of this invention, and since they are relatively delicate items, this invention facilitates their removal. In the prior art, archers have typically not always removed the sight or rest, which can lead to their damage or misalignment. The present invention has addressed this problem by making them both easily removable as a one-piece item.

These and other features of the present invention can be best understood from the following specification and drawings of which the following is a brief description,

BRIEF DESCRIPTION OF THE DRAWINGS

FIG. 3 is a side view along line 3—3 as shown in FIG. 2.

FIG. 4 is a cross-sectional view along line 4—4 as shown in FIG. 3.

FIG. 5A illustrates a properly aimed arrow in the prior art.

FIG. 5B illustrates a problem with the prior art archery arrangements,

FIG. 5C shows the effect of proper aiming with the present invention.

FIG. 5D shows the negation of any undesirable effect from archer induced torque with the present invention.

DETAILED DESCRIPTION OF THE PREFERRED EMBODIMENT

As explained with reference to FIGS. 5A and 5B, when an overdraw system is incorporated into a bow handle, the undesirable effects of archer induced torque become more pronounced progressively as the distance between the sight and rest increases. The present invention addresses the undesirable effects of archer induced torque by aligning the forward sight generally vertically above the arrow rest, and rearwardly of the handle. Any torque will have as much effect on the arrow sight as it does on the arrow rest. Thus, even if torque is applied, it will have no effect on the aiming of the arrow.

Figure 1:
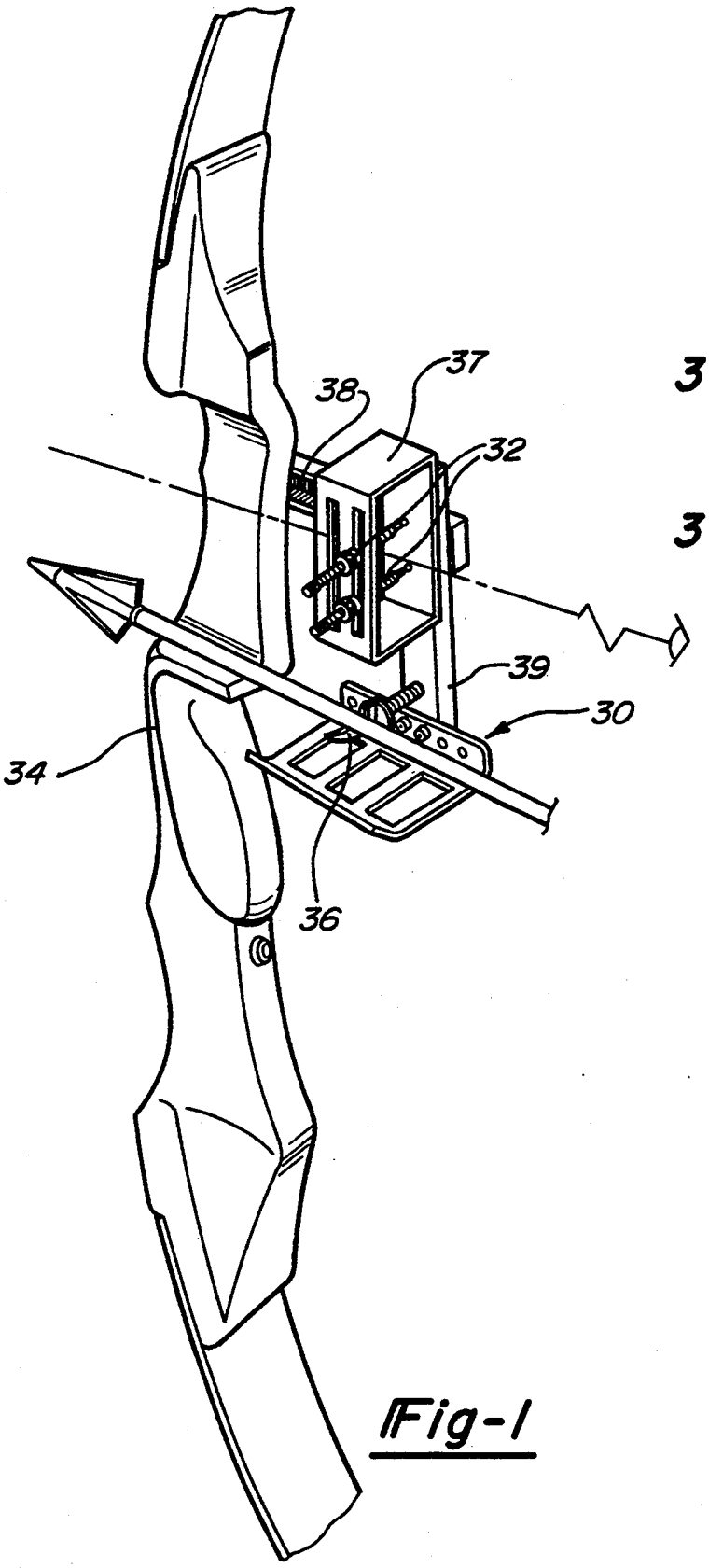
FIG. 1 is a perspective view showing the sight/arrow rest of the present invention.

As shown in FIG. 1, a sight/rest assembly 30 incorporates forward sight pins 32 which are attached to a bow handle 34. An arrow rest 36 is positioned vertically directly below the sight pins 32. Both are behind the handle, and thus assembly 30 provides an overdraw assembly. A rearwardly extending bar 38 extends from the bow handle 34 rearwardly. The sight pins 32 and rest 36 are preferably generally aligned along a vertical axis in use. When applicant uses the term "generally aligned" applicant intends to imply that the sight is on a vertical axis that is within two inches of a vertical axis passing through the rearwardmost point of the arrow rest. It is more preferred that the sight be on an axis that is within one inch of an axis passing through the rearwardmost point of the arrow rest, and it is most preferred that they be identically axially aligned.

As further shown, a downwardly extending bar 39 is attached to the rearwardly extending bar 38. As will be explained below, there is a connection structure ensuring the downwardly extending bar 39 remains perpendicular to rearwardly extending bar 38, to in turn ensure that the sight pins 32 remain properly positioned relative to rest 36. As shown, pins 32 are received in a sight assembly 37 which is attached to downwardly extending bar 39. As further shown, rest 36 is also attached to downwardly extending bar 39.

Figure 2:
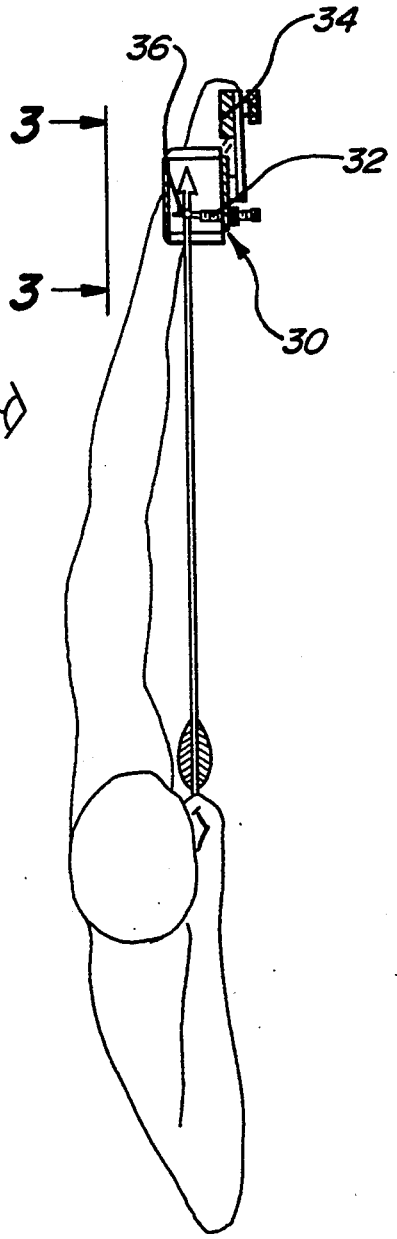
FIG. 2 is a top view showing the use of the present invention.

As shown in FIG. 2, the forward sight pins 32 are positioned directly vertically above the arrow rest 36 with the present invention. The present invention thus incorporates an overdraw moving the rest rearwardly of the bow handle, and also provides a sight that is positioned above the arrow rest.

As shown in FIG. 3, the sight/rest assembly 30 includes rearwardly extending bar 38 having a plurality of alignment holes 40. The alignment holes 40 are attached to a bolt 42 extending from the standard sight attachment hole on the bow 34. By selecting one of the plurality of alignment holes 40, the archer can select the distance between handle 34 and the arrow rest and sight to control the amount of overdraw provided by sight/rest assembly 30. As further shown, the rest 36 is positioned directly vertically below the sight pins 32.

As shown in FIG. 4, the handle 34 receives two screws 49 extending into the standard holes and a mounting member 50. Mounting member 50 has an outer face 52 which is received within a corresponding recess 54 associated with the rearwardly extending bar 38. Bolt 42 extends outwardly of mounting member 50 and through a opening in rearwardly extending bar 38.

A thumb nut 56 is received on bolt 42 to secure the rearwardly extending bar 38 to handle 34. The use of the corresponding surfaces ensure that the rearwardly extending bar extends directly perpendicularly rearwardly from handle 34. This will in turn ensure that the downwardly extending bar extends directly vertically downwardly, and that sight pins 32 are properly aligned relative to rest 36.

As show in FIG. 5C, with the present invention, when there is no torque, the sight line from the peep sight through the sight and the air travel line throughout the rest both extend directly to target 28. This is similar to the situation with a properly aimed arrow in the prior art. As shown in FIG. 5D, should there be archer induced torque twisting the handle to the right, the archer's sighting would still pass from the peep sight through the sight pin to the target. Since the sight pins are on the same vertical line as the rest, this would be the same line from the bow string through the rest, which is the flight path for the arrow. Thus, the archer induced torque on the handle will have no ill effect on the aiming of the arrow.

In short, contrary to all proposed prior art solutions, applicant's invention does not attempt to correct torque or provide an indication to an archer that torque is occurring. Rather, applicant has recognized that by properly aligning the sight and arrow rest the effects of torque can be negated. Applicant's solution is thus a complete elimination of any undesirable effects of torque, and does not complicate the shooting process.

Figure 6:
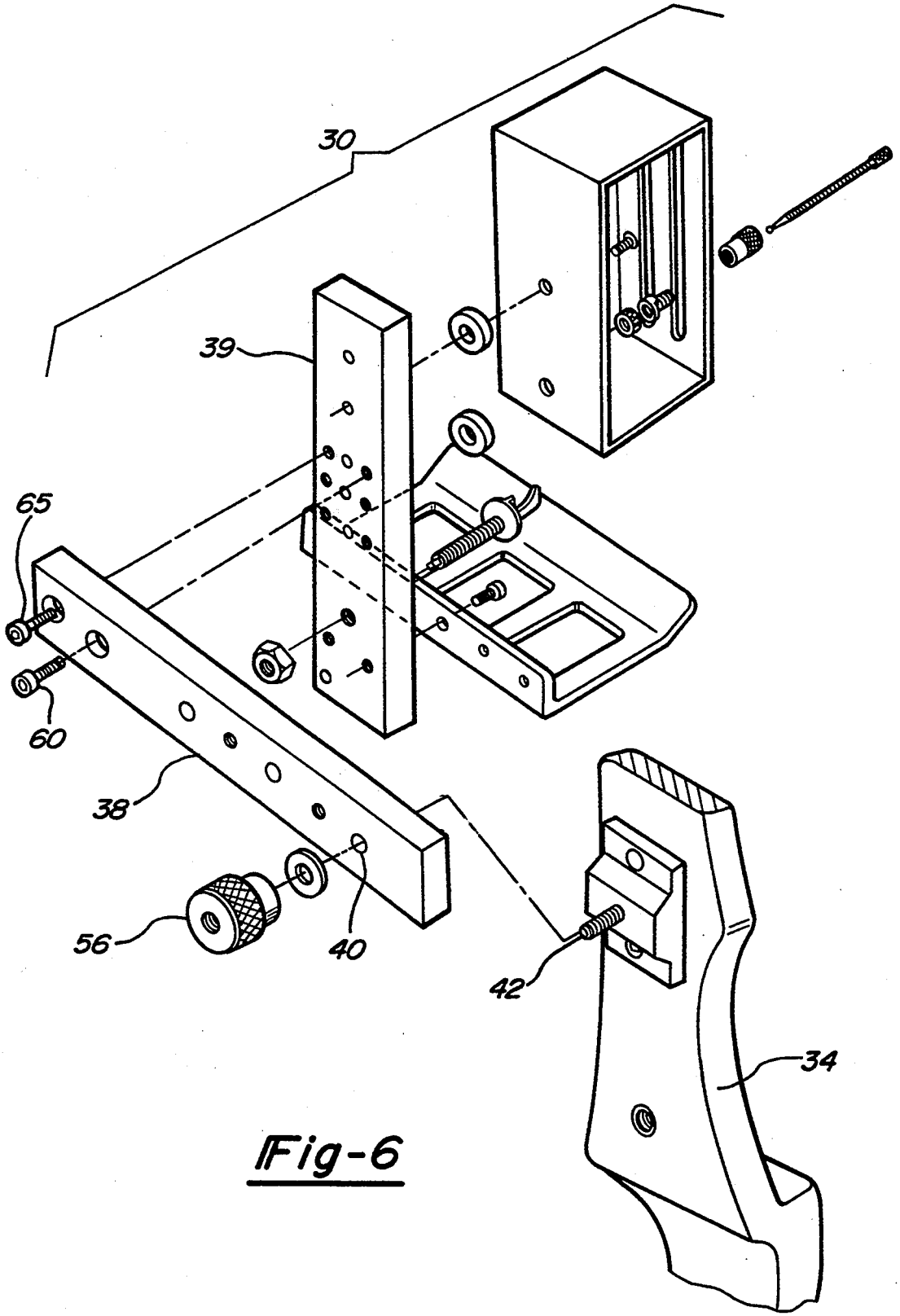
FIG. 6 is an exploded view of the features of the present invention.

As shown in FIG. 6, bow handle 34 includes bolt 42 extending through one of the holes 40 in rearwardly extending bar 38. The downwardly extending bar 39 is connected by at least two axially spaced bolts 60 to the rearwardly extending bar 38. Thus, one may ensure that downwardly extending bar 39 extends perpendicularly to the rearwardly extending bar 38, and that the sight/rest assembly 30 is properly aligned. As further shown, there are a plurality of sets of holes on downwardly extending bar 39 to receive rearwardly extending bar 38. This allows the archer to adjust the relative vertical positions of the rearwardly and downwardly extending bars, and consequently, the sight and rest relative to the bow handle. Further, there are a plurality of holes for mounting the sight such that the distance between the sight and the rest may also be adjusted.

In one further feature that is provided by the one-piece sight/rest of this invention, the entire rest and sight combination can be easily removed from the bow by merely removing thumb nut 36. One may thus quickly and easily remove the one-piece combination. The use of the mounting arrangement ensures that the one-piece sight and rest may be quickly and accurately reattached to the bow. An archer will now be able to remove the relatively delicate sight and rest combination 30 from the bow when the bow is being stored. Since bows are often stored in vehicle trunks, they may be subject to rough treatment. Since the sight and rest must be accurately positioned for optimum performance, it is always desirable that they not be subjected to treatment which could cause misalignment. Applicant's invention which facilitates the removal of the sight and rest as a one-piece unit thus provides benefits in protecting the sight and rest thereby increasing the accuracy of their use.

A preferred embodiment of this invention has been disclosed. However, a worker of ordinary skill in the art would recognize that certain modifications would come within the scope of this invention. For that reason the following claims should be studied in order to determine the true scope and content of this invention.

I claim:

1. An archery bow comprising:

a bow handle at a first axial position forward of the archer's body in use;

an archery sight positioned rearwardly of the rearwardmost portion of said handle and towards the archer;

an arrow rest the supporting an arrow at a contact point positioned rearwardly of the rearwardmost portion of said bow handle and towards the archer; and said sight and said rest being generally spaced from said bow handle by a distance selected such that a vertical axis passing through the sight is at generally the same position as a vertical axis passing through said rest.

2. An archery bow as recited in claim 1, wherein said axis passing through said sight would also pass through the rearwardmost point of said rest.

3. An archery bow as recited in claim 1, wherein said sight and said rest are removable as a one-piece item.

4. An archery bow as recited in claim 3, wherein said sight is positioned vertically above said rest, and the distance that said sight is positioned above said rest being adjustable.

5. An archery bow as recited in claim 3, wherein said one-piece item is attached to a standard sight bolt hole on said bow handle.

6. An archery bow as recited in claim 3, wherein said one-piece item includes a rearwardly extending bar connected to, and extending rearwardly from, said handle, a downwardly extending bar being positioned perpendicularly to said rearwardly extending bar, and said sight and said rest being attached to said downwardly extending bar.

7. An archery bow as recited in claim 6, wherein said rearwardly extending bar includes a cross-sectional shaped recess which is received on a corresponding alignment structure on said bow handle to ensure that said rearwardly extending bar extends perpendicularly to said bow handle, to in turn ensure that said vertically extending bar extends generally vertically downwardly.

8. An archery bow as recited in claim 3, wherein said distance from said bow handle to said sight and said rest is adjustable.

9. An archery bow as recited in claim 8, wherein said sight and said arrow rest are attached to said bow handle by a rearwardly extending bar, said rearwardly extending bar including a plurality of holes, with one of said holes being positioned on a bolt on said bow handle to attach said rearwardly extending bar to said bow handle, and the selection of one of said plurality of holes allowing the adjustment of the distance between said sight and said rest to said bow handle.

10. An archery bow as recited in claim 3, wherein said one-piece item is attached to said bow handle by a thumb nut such that said one-piece item may be easily removed from the said bow handle.

11. An archery bow as recited in claim 1, wherein a vertical axis passing through said sight is within one inch of a vertical axis passing through a rearwardmost point on said rest.

12. An archery sight and arrow rest combination comprising:

a rearwardly extending bar having means for attachment to a standard bolt hole for attaching a sight to a bow handle;

a sight being attached to said rearwardly extending bar at a location that will be rearward of the rearwardmost portion of the handle; and an arrow rest also being attached to said rearwardly extending bar, and having an arrow contact point at a location that will be rearward of the rearwardmost portion of the bow handle.

13. An archery sight and arrow rest combination as recited in claim 12, wherein said sight is positioned generally vertically above said arrow rest such that in use, a vertical axis which extends through said sight will be generally equal to a vertical axis which extends through said rest.

14. An archery sight and arrow rest combination as recited in claim 13, wherein said axis which extends through said sight would also extend through a rearwardmost point of said arrow rest.

15. An archery sight and arrow rest combination as recited in claim 14, wherein said rearwardly extending bar is attached to a downwardly extending bar in such a way that it is ensured that said downwardly extending bar is perpendicular to said rearwardly extending bar, and said sight and said arrow rest are attached to said downwardly extending bar.

16. An archery sight and arrow rest combination as recited in claim 13, wherein a thumb nut attaches said rearwardly extending bar to a bolt on a bow handle such that said sight and arrow rest combination may be easily removed from said bow handle.

17. An archery sight and arrow rest combination as recited in claim 16, wherein said rearwardly extending bar includes a mounting member having a cross-sectional shaped recess which is adapted to be received on a corresponding structure on a bow handle to ensure that said rearwardly extending bar extends in a generally perpendicular direction to a bow handle.

18. An archery sight and arrow rest combination comprising:

a rearwardly extending bar, having means at a forward position to attach said bar to a bow handle;

a sight attached adjacent a rearward end of said rearwardly extending bar, and at a position that will be rearward of the rearward most portion of the bow handle; and an arrow rest also attached adjacent a rearward end of said rearwardly extending bar, and having a contact point for contacting an arrow that is rearward of the rearwardmost portion of the bow handle, said arrow rest being positioned generally vertically below said sight such that in use, a vertical axis which passes through said sight will also be generally aligned to a vertical axis which passes through a rearwardmost point on said rest.

19. An archery sight and arrow rest combination as recited in claim 18, wherein said axis which passes through said sight would also pass through said rearwardmost point on said arrow rest.

20. An archery sight and arrow rest combination as recited in claim 19, wherein said sight and said arrow rest are attached to a vertically extending bar which is attached adjacent a rearward end of said rearwardly extending bar.

* * * * *